US007300207B2

(12) United States Patent
Linneweil

(10) Patent No.: US 7,300,207 B2
(45) **Date of Patent: *Nov. 27, 2007**

(54) CLOSURE FOR CONTAINERS AND RECLOSABLE CONTAINERS INCLUDING THE SAME

(76) Inventor: Ron Linneweil, 38 Armon St., Neve Ilan, Yavneh 81512 (IL)

( * ) Notice: Subject to any disclaimer, the term of this patent is extended or adjusted under 35 U.S.C. 154(b) by 345 days.

This patent is subject to a terminal disclaimer.

(21) Appl. No.: 10/681,925

(22) Filed: Oct. 9, 2003

(65) Prior Publication Data

US 2004/0208400 A1 Oct. 21, 2004

Related U.S. Application Data

(63) Continuation-in-part of application No. 10/414,899, filed on Apr. 16, 2003, now Pat. No. 6,988,828.

(51) Int. Cl.

| | |
|---|---|
| ***B65D 33/00*** | (2006.01) |
| ***B65D 33/02*** | (2006.01) |
| ***B65D 33/16*** | (2006.01) |
| ***B65D 30/20*** | (2006.01) |

(52) U.S. Cl. ..... 383/35; 383/34; 383/61.2; 383/63; 383/65; 383/68; 383/120; 383/204

(58) Field of Classification Search ..... 383/68, 383/63, 65, 35, 120, 203–204, 34, 34.1, 61.2
See application file for complete search history.

(56) References Cited

U.S. PATENT DOCUMENTS

| | | | | |
|---|---|---|---|---|
| 2,666,466 | A * | 1/1954 | Sharat | 383/65 |
| 2,789,609 | A * | 4/1957 | Post | 383/65 |
| 4,787,755 | A | 11/1988 | Branson | |
| 4,807,300 | A * | 2/1989 | Ausnit et al. | 383/65 |
| 4,871,264 | A * | 10/1989 | Robbins et al. | 383/68 |
| 5,037,138 | A * | 8/1991 | McClintock et al. | 383/34 |
| 5,403,094 | A | 4/1995 | Tomic | |
| 5,622,431 | A | 4/1997 | Simonsen | |
| 5,934,806 | A | 8/1999 | Tomic et al. | |
| 6,082,897 | A | 7/2000 | Galomb | |
| 6,132,089 | A | 10/2000 | Galomb et al. | |
| 6,168,312 | B1 * | 1/2001 | Hausslein | 383/68 |
| 6,231,235 | B1 | 5/2001 | Galomb et al. | |
| 6,234,676 | B1 | 5/2001 | Galomb et al. | |
| 6,988,828 | B2 * | 1/2006 | Linneweil | 383/68 |

* cited by examiner

*Primary Examiner*—Jes F. Pascua
(74) *Attorney, Agent, or Firm*—Davidson Davidson & Kappel, LLC

(57) ABSTRACT

The present invention relates to an air-tight closure for enhancing accessibility to contents of a container when the container is opened and for preventing exposure of the container contents to ambient air when the container is closed. The invention further relates to re-closable containers including the same. The closure comprises at least two elongated male units disposed a gap apart on the outer surface of one wall of the container and at least two corresponding elongated female units disposed a gap apart on the outer surface of an opposite wall of the container opposite the male units, forming at least two male-female pairs. The closure may further include a tongue for facilitating opening the container.

30 Claims, 10 Drawing Sheets

CLOSURE FOR CONTAINERS AND RECLOSABLE CONTAINERS INCLUDING THE SAME

RELATED APPLICATIONS

This application is a continuation-in-part of U.S. patent application Ser. No. 10/414,899 filed on Apr. 16, 2003, now U.S. Pat. No. 6,988,828 the contents of which are incorporated herein by reference.

BACKGROUND OF THE INVENTION

1. Field of the Invention

The present invention generally relates to closure means for containers and more specifically to an air-tight snap closure for allowing re-opening and re-closing of a container for keeping the freshness of the container contents.

2. Discussion of the Related Art

Various off-the-shelf goods, such as food products, are distributed in sealed packages to ensure that the package was not opened before purchasing, to prevent spillage of contents and to prevent exposure of the package contents to ambient atmosphere. For various food products, it is also common to seal the package under vacuum, as is well known in the art, for better protecting the products. Once purchased, the initial seal is broken in order to access the package contents.

However, many times the contents of the package are not consumed immediately but over a period of time. For this reason, there exist various secondary closure means which allows re-closing and re-opening of a container after the container is first opened and which serves both for preventing accidental spillage of the contents and for keeping the freshness of the contents by minimizing the exposure of the container contents to air. Re-closable closures appear in different forms and may be provided either as an integral part of the container or as a separate unit. One family type of such closures comprises two compatible parts deposited on opposite walls of a container which when pressed together form a tight sealing. The two parts may be secured either on the inner or on the outer surfaces of the container walls. In the first case, when closed, the two closure parts are in immediate contact with each other. In the second case, the walls of the container are interposed between the closure members. External closures have some advantages to internal closures. External closure can be attached to a container after it has already been filled and sealed while inner closures can be attached only to empty containers, thus, the step of securing an inner closure must be integrated into the packages production line. Securing an external closure to a package, on the other hand, can be performed at a later stage, hence offering more flexibility. Furthermore, internal closures do not fit for some goods, such as for example powder-like products, which tend to accumulate on the closure surface, hindering the closure operation.

Known external closure means, although superior to inner closure, still suffer from a number of drawbacks. One such a drawback is the limit to the separation that can be obtained between the two opposite walls of the container for forming a mouth or an opening sufficiently large to allow convenient access to the container contents This drawback is particularly crucial for bags known in the art as non-gusseted bags, where the two walls of the container are directly connected to each other with no intermediate side walls. Another drawback is the extent of the force that should be applied in order to separate the two parts of the closure. Yet another drawback is that for non-gusseted packages a continuous pressure should be applied to the closure in order to maintain the closure in the open position.

Accordingly, it is the object of the present invention to provide an air-tight closure means for containers which can be used with any container and in particular with non-gusseted as well as with gusseted packages and which is easily opened without applying much forces.

It is another object to provide such a closure which when opened forms a well defined mouth or an opening that remains open with no need to apply further pressure by the user.

It is another object of the invention to provide such a closure that is inexpensive and is easily produced and applied to any container.

Other advantages of the invention will be apparent from the following description.

SUMMARY OF THE PRESENT INVENTION

The present invention provides an air-tight closure for a container for allowing re-closing the container after it is initially opened and for enhancing accessibility to the container contents when opened. The invention further relates to re-closable containers including the same.

The closure of the present invention can be used with any container having two opposite walls connected to each other and a mouth for providing accessibility to the container contents, wherein the mouth may be initially sealed. In particular, the present closure can be used with a container fabricated from a single layer or multi-layer sheet of a flexible material such as plastic, paper, a metal foil or a combination thereof. The invention further provides re-closable containers including the same.

The closure of the invention comprises at least two elongated male units, disposed a gap apart on the outer surface of one wall of the container adjacent to the mouth, such that their longitudinal axes coincide and at least two corresponding female units, disposed a gap apart on the outer surface of the second opposite wall, opposite the male units. The male and female units are configured to snap fit into each other such as to form at least two pairs of male-female pairs. The closure may be disposed along the width of the container or diagonally. The construction of the closure facilitates the opening of the container and enables the closure to remain in its opened position without applying continuous forces.

In accordance with one embodiment of the invention the male units comprise two flat elongated wings and an elongated projection interposed there between. The female unit comprises two flat elongated wings and an elongated recess portion interposed there between. The male elongated projection and the female elongated recess portion are having complementary profiles for allowing snap fitting said projection into said recess portion. Preferably, the male units are secured to the outer surface of one wall of the container by adhesive layer or by any other bonding technology, such as heat seal etc., covering at least partly the elongated flat wings. The female units are secured to the outer surface of the other wall of the container by adhesive layer or other bonding technology covering at least partly the elongated recess portion.

In accordance with one embodiment of the invention, the male unit and the female unit of each male-female pairs, when manufactured, are connected to each other by two elongated strips interposed there between. The two elongated strips are connected to each other and to the male and female units by thin breakable connections for allowing securing the closure to the mouth of the container strips by folding the closure around the connection between the two elongated strips such that one elongated strip connected to the male unit is disposed on one wall of the container and the second elongated strip connected to the female unit is disposed on the second wall of the container.

Yet in accordance with a further embodiment of the invention the closure may include at least one flap-like tongue member for facilitating opening the closure.

BRIEF DESCRIPTION OF THE DRAWINGS

The present invention will be understood and appreciated more fully from the following detailed description taken in conjunction with the drawings in which:

FIG. 3A illustrates the bag before initial seal is broken; FIG. 3B illustrates the bag in a closed position after the initial seal is broken; FIG. 3C illustrates the bag in an open position;

FIG. 4A illustrates the bag before initial seal is broken or removed; FIG. 4B illustrates the bag in a closed position after the initial seal is broken or removed; FIG. 4C illustrates the bag in an open position;

FIG. 5A illustrates the bag before initial seal is broken; FIG. 5B illustrates the bag in a closed position after the initial seal is broken; FIG. 5C illustrates the bag in an open position;

DETAILED DESCRIPTION OF THE PREFERRED EMBODIMENT

Figure 1A:
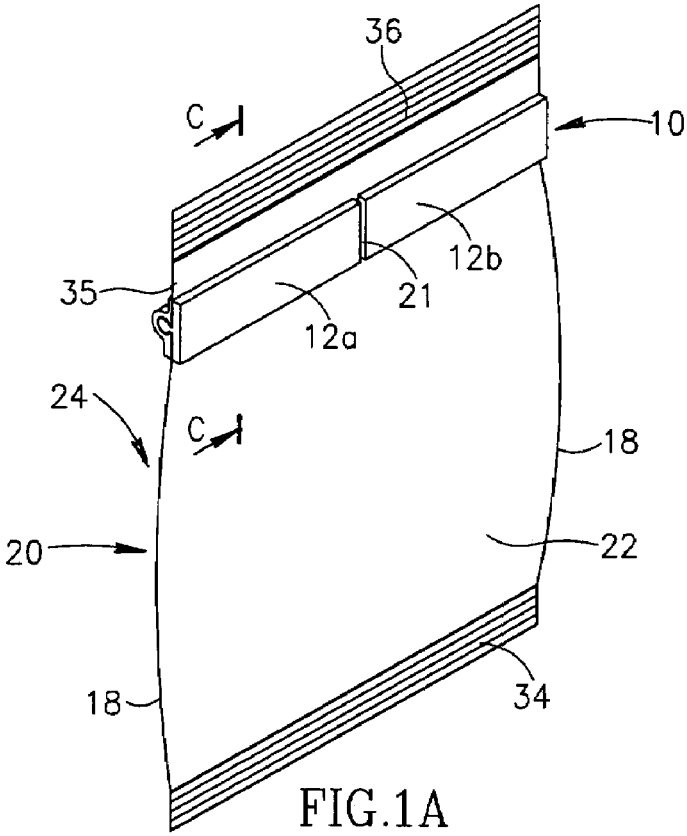
FIGS. 1A and 1B illustrate a non-gusseted flexible bag with a closure in accordance with a first embodiment of the present invention in closed and open positions, respectively.

The present invention provides an air-tight closure for a container for allowing re-closing the container after it is initially opened and for enhancing accessibility to the container contents when opened. The present invention is a continuation-in-part of U.S. patent application Ser. No. 10/414,899 filed on Apr. 16, 2003, the contents of which are incorporated herein by reference.

Referring to the drawings, FIG. 1A-1D show a closure, generally designated 10, in combination with a flexible bag, generally designated 20, in accordance with one embodiment of the present invention. The closure enables the bag to be re-closed and reused. The closure comprises two or more separate sections having a gap there between. Bag 20 comprises two opposite walls, a front wall 22 and a rear wall 24 connected at lateral sides 18 and sealed at their bottom and top by seals 34 and 36, respectively. The bag is preferably made of a single or multi layer sheet material such as plastic film, paper, metalized foil or combination thereof. Bag 20 may be formed from a sleeve or by connecting two sheets 22 and 24 or as more commonly known in the art, from a single folded sheet connected along the folded edges by a fin seal at the rear wall (not shown) to form a tube which is first sealed at the bottom (i.e., seal 34) to form a pocket and after the pocket is filled, the remaining top opening (i.e., the package mouth) is sealed by seal 36.

One method to form seal 36 is by heat sealing the two walls directly to one another along transversely sealing lines, as shown in FIG. 1A, to form a sealing band. The sealing band can be made tearable by perforating or by laser scoring along a line just below the sealing band for facilitating tearing the band. Alternatively, the sealing band can be cut off by scissors. Other methods for sealing a package mouth may involve inclusion of a peelable strip between the inner surfaces of the walls, applying a sealant layer on the inner surfaces along a sealing line which breaks when the two upper edges of opposite walls are pulled apart, etc. It will be realized that any method known in the art for sealing a package may be used in conjunction with the present invention and that the sealing methods are not limited to what is shown.

Closure 10 is secured to bag 20 at a predetermined distance below seal 36, leaving unsealed portions 35 and 33 between seal 36 and the upper edge of closure 10. Closure 10 comprises a pair of male units 12*a* and 12*b*, attached to the external surface of wall 22 and a pair of female units 14*a* and 14*b* (not seen) attached to the external surface of rear wall 24 opposite male units 12. Male units 12*a* and 12*b* are rigid or semi rigid elongated members spaced apart by a small gap 21, adjacent to each other along their narrow end. Female units 14*a* and 14*b* are rigid elongated parts spaced apart by a corresponding gap (not seen), located opposite units 12*a* and 12*b*, respectively. The gap 21 can be a cut separating between male units 12*a* and 12*b* and between female units 14*a* and 14*b*. In an alternative embodiment, gap 21 comprises a gap a millimeter or more separating between male units 12*a* and 12*b* and separating between female units 14*a* and 14*b*. Gap 21 can be wider depending on the type of bag 20 and closure 10 material used. Male units 12 and female units 14 are having complementary profiles such that they snap fit into each other.

Figure 1C:
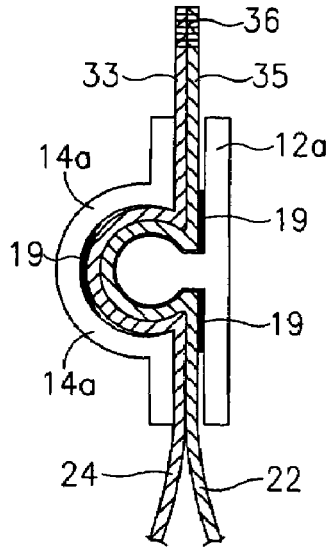
FIGS. 1C and 1D are a cross-sectional view along lines C and D of FIGS. 1A and 1B, respectively.
Figure 1B:
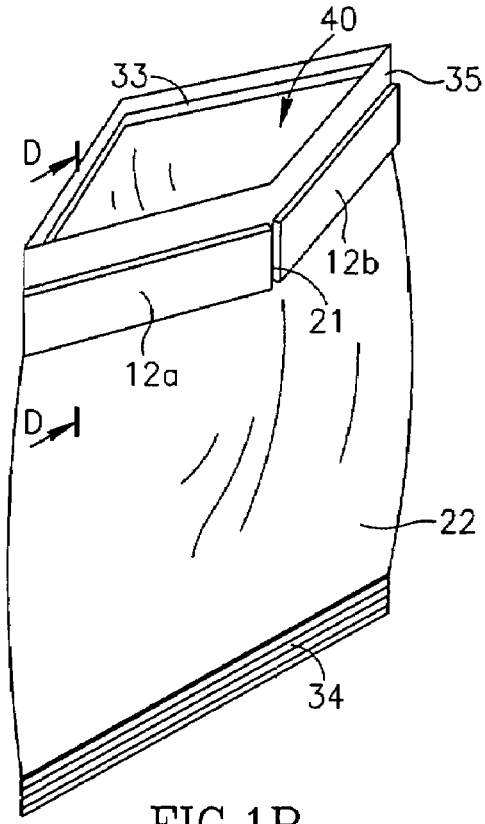
Figure 1D:
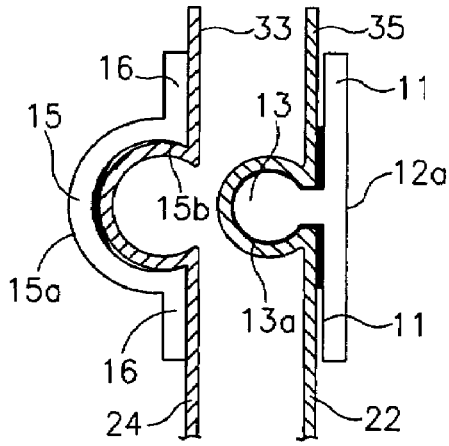

As can be best seen in FIGS. 1C and 1D, male units 12*a* and 12*b* each comprises two flat elongated wings 11 and a middle elongated rounded projection 13 positioned there between. Male units 12 are attached to the external surface of wall 22 by adhesive layer generally designated 19, covering partly the inner surface of wings 11. Alternatively, units 12 may be secured to wall 22 by any other bonding or attaching technique, such as heat sealing, pressure sealing, sewing, pins attaching the respective faces, stapling and any other form of attaching. As can be seen, contact area 19 need not to cover the whole surface of wings 11, but can cover only the portions proximate to projection 13. Female units 14*a* and 14*b* each comprises a middle rounded recess portion 15 having an outer surface 15*a* and an inner surface 15*b* positioned between two flat wings 16. Female units 14*a* and 14*b* are attached to the external surface of wall 24 by adhesive layer 19, or any other bonding technology, covering the inner surface 15*b* of rounded recess portion 15. When closure 10 is secured to bag 20, units 12 and 14 are pressed against walls 22 and 24 such that walls 22 and 24 are folded to conform with the inner surface of units 12 and 14, respectively.

FIGS. 1A and 1B depict bag 20 in a closed and an open positions, respectively. Preferably, closure 10 is provided with bag 20 while the closure is in its closed position. In order to access the contents of bag 20, seal 36 is first broken or removed, then by pulling rims 33 and 35 outwardly, closure 10 is opened to form a wide open diamond shape mouth 40. It would be appreciated that although in the embodiment shown here, seal 36 is cut off, bag 20 may be provided with any seal as described above. One such alternative exemplary seal is a piece of adhesive plastic or paper connecting rims 33, 35 placed along side rims 35, 36 or across said rims. Thus, when the seal is of the type that is opened by pulling apart the two opposite walls of the container, with no need to cut the seal, the closure of the invention may be secured to the container right below the seal with no need to leave rims between the seal and the closure.

Due to the construction of closure 10, mouth 40 remains in the opened position with no need for applying further forces. Mouth 40 provides a very convenient access to the contents of bag 20. Thus, the contents of the bag can be accessed either by inserting a scooping device, e.g., a spoon or fingers, through the mouth or by pouring the contents by tilting the bag. It will be appreciated that the rigid angled corner of mouth 40 facilitates pouring the bag contents in a directed manner without accidental spillage in the surrounding. It will be also appreciated that for a non-gusset bag, as bag 20, a wide-open mouth or opening which remains in an open position without applying further forces or pressure cannot be obtained with only one pair of male-female members. In order to re-close the bag, units 12 are pressed against units 14 for obtaining an air-tight closing. In the embodiment shown here, female units 14 are having some degree of elasticity in the vertical direction, i.e. in the direction of wings 16, for allowing rounded recess 15 to enlarge upon insertion of projection 13 and to apply pressure on projection 13 for forming tight contact between walls 2 and 24.

Closure 10 may be fabricated from any rigid or semi rigid material. For example, the closure may be fabricated from plastic materials such as polyethylene, polypropylene and the like by extrusion, by injection molding or by any other methods known in the art. Alternatively, the closure may be fabricated from alloy metal and other types of metal such as aluminum.

FIG. 2 depict a second embodiment of a closure of the present invention, designated 50, in a combination with a gusseted package 60. Package 60 comprises two opposite walls 62 and 64, a flat bottom 63 and two side walls 65 folded inwardly along lines 67 to form gussets. Package 60 is preferably fabricated from a one layer or multi-layer flexible sheet folded and is sealed along folded edges to form a gusseted package in accordance with any method known in the art. Package 60 is sealed at its upper portion by seal 66 in a similar manner as explained in association with FIG. 1.

Closure 50 is secured to package 60 below seal 66 separating the interior of package 60 from its upper sealed portion. Closure 50 comprises a pair of male units 52*a* and 52*b* (not seen) disposed on wall 64 and a pair of female units 54*a* and 54*b* disposed on wall 62. Units 52*a* and 52*b* as well as units 54*a* and 54*b* are spaced apart by gap 71. After seal 66 is broken, closure 50 can be easily opened by pulling rims 73 and 75 apart to form mouth 70 as can be seen in FIG. 2B. Gaps 71, being weak points along the longitudinal axes of closure 50, serve as hinges for facilitating the opening of the closure without applying much force. The gaps 71 can be a cut separating between male units 52*a* and 52*b* and between female units 54*a* and 54*b*. In an alternative embodiment, gaps 71 comprise a gap a millimeter or more separating between male units 52*a* and 52*b* and separating between female units 54*a* and 54*b*. Gap 71 can be wider depending on the type of package 60 and closure 50 material used.

Figure 2A:
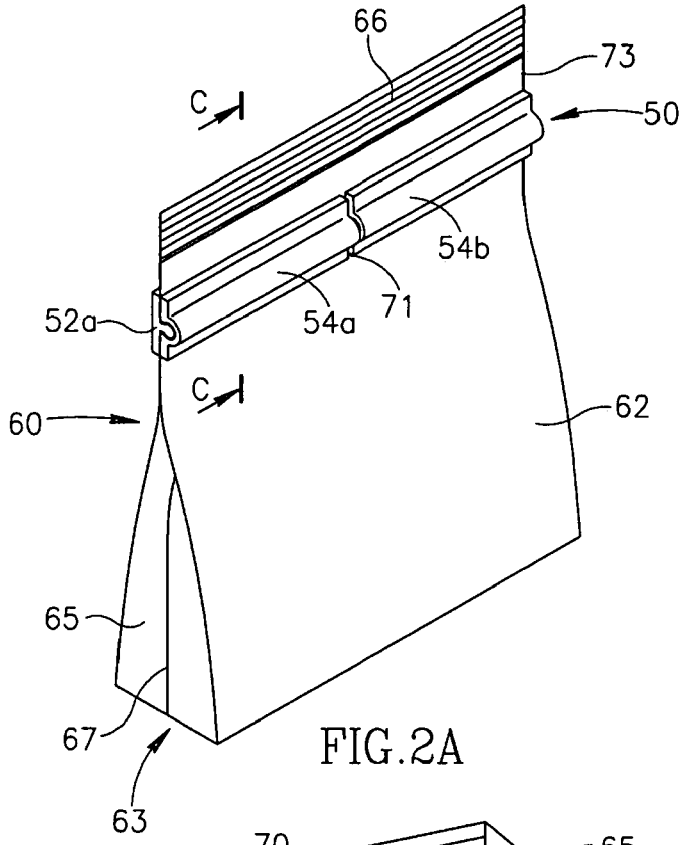
FIGS. 2A and 2B illustrate a gusseted flexible bag with a re-closable closure in accordance with a second embodiment of the present invention in closed and open positions respectively.
Figure 2C:
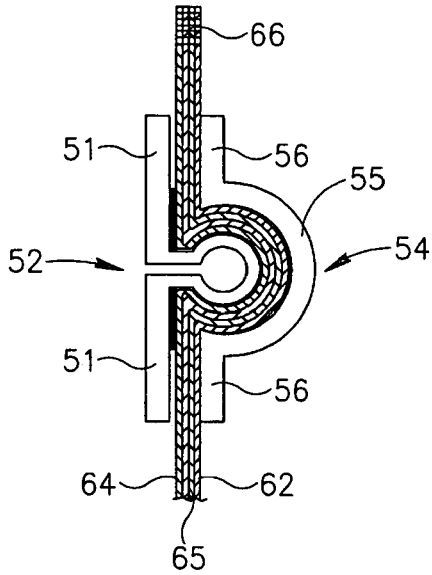
FIGS. 2C and 2D are a cross sectional view along lines C and D of FIGS. 2A and 2B, respectively.
Figure 2B:
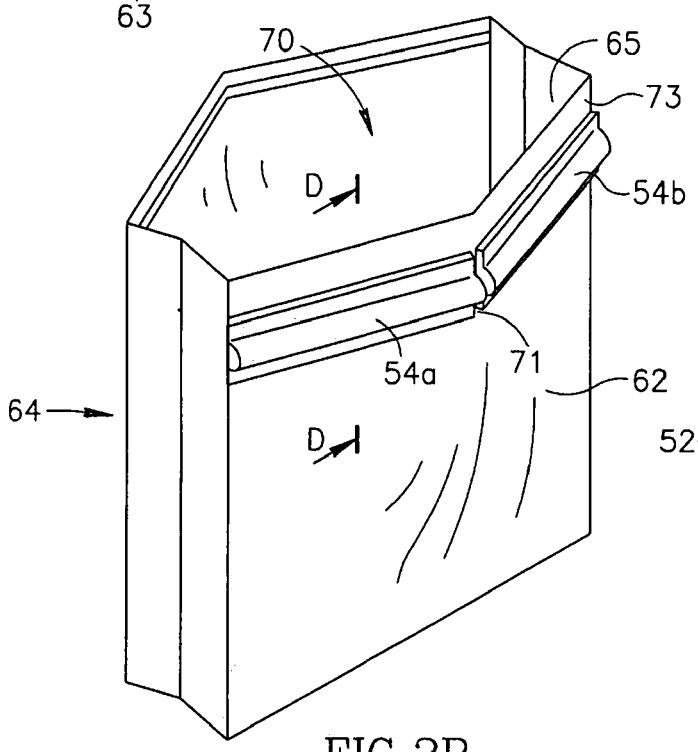
Figure 2D:
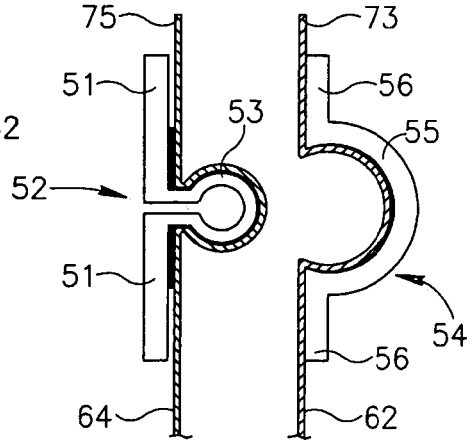

The profiles of male members 52 and female 54 are best seen in FIGS. 2C and 2B. As is seen, female units 54, comprising two flat wings 56 and a rounded recess 55 positioned there between, have a similar shape as female units 14 of FIG. 1. In accordance with the embodiment shown here, male units 52 also have a similar profile, comprising a rounded unfilled projection 53 positioned between two wings 51, such that, unlike male units 12 of FIG. 1, male units 52 have a substantially uniform cross sectional thickness. In fact, male units 52 and female units 54 may be almost identical units, wherein the internal diameter of recess 55 is slightly larger than the external diameter of projection 53. The flexibility in the vertical axis, as explained above in conjunction with female members 14 of FIG. 1, allows for the insertion of members 52 into members 54.

It will be appreciated by persons skilled in the art that the male-female profiles of the closure of the invention may assume other shapes as well, and are not limited to what is shown here, as long as they have complementary profiles for providing tight contact between the male-female pair and the package walls interposed there between, when the closure is in the closed position.

Figure 3A:
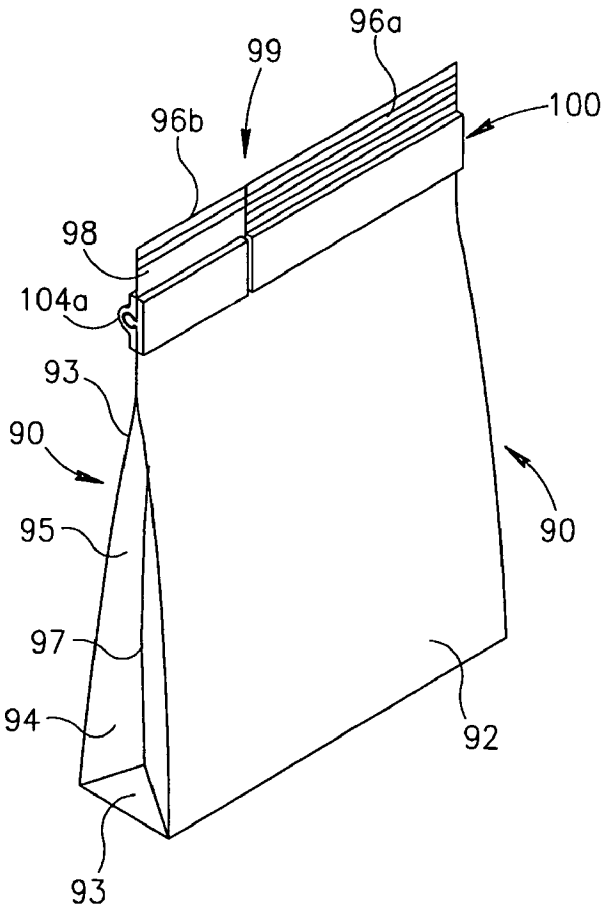
FIGS. 3A-3C illustrate a flexible bag with a closure in accordance with a third embodiment the present invention.
Figure 3B:
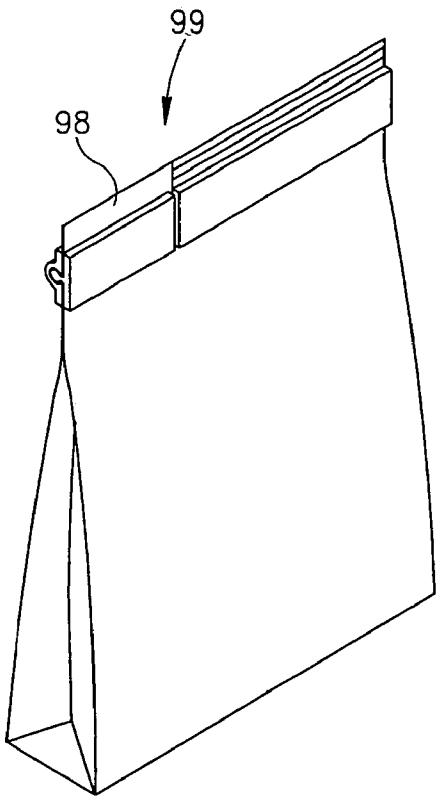
Figure 3C:
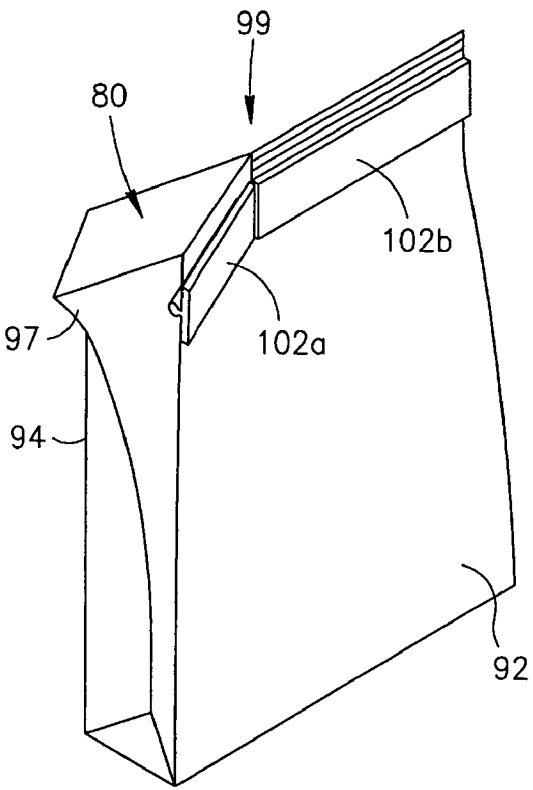

FIG. 3 depict yet another embodiment of a gusseted package, designated 90, with a closure of the invention, designated 100. Closure 100 comprises two male elongate units 102*a* and 102*b* and two female units 104*a* and 104*b* of a shape similar to male units 12 and female units 14 of FIG. 1, respectively. Package 90 comprises two opposite walls 92 and 94, a flat bottom 93 and two side walls 95 folded inwardly along lines 97. Package 90 is sealed at its upper portion by seal 96 comprising two portions of different widths, 96*a* and 96*b*, such that seal portion 96*a* ends just above closure 100 or extends further downwardly and ends lower than the to edge of closure 100, while portion 96*b* ends a distance above closure 100, leaving an unsealed band 98 above the closure. The proportions of portions 96*a* and 96*b* and closure parts 102*a*, 102*b* can vary and are not limited by what is shown in FIGS. 3A, 3B, 3C. In an alternative embodiment of the present invention, portion 96*a* can be shorter and portion 96*b* can be longer than is shown and respective closure parts 102*a*, 102*b*, 104*a* and 104*b* can be in respective sizes to fit portions 96*a*, 96*b*.

Package 90 is further provided with a vertical line seal 99 separating between portions 96*a* and 96*b*. Vertical seal 99 extends from top to substantially the lower end of closure 100. The lengths of male-female pair 102-104*a* and pair

102-104*b* match the lengths of seal portion 96*a* and 96*b*, respectively. In order to access the contents of package 90, the upper portion of the package is cut off or removed above closure 100 to leave an unsealed portion above closure pair 102-104*a*, as shown in FIG. 3B, such that only pair 102-104*a* can be opened to form mouth 80, as shown in FIG. 3C. Thus, in accordance with this embodiment, the main role of male-female pair 102-104*b* is to provide a barrier against erroneous cutting of the package. For example, if only pair 102-104*a* was provided, package 90 might have been cut wrongly at the right side of the package, rendering closure 100 useless.

Figures 4A, 4B, 4C:
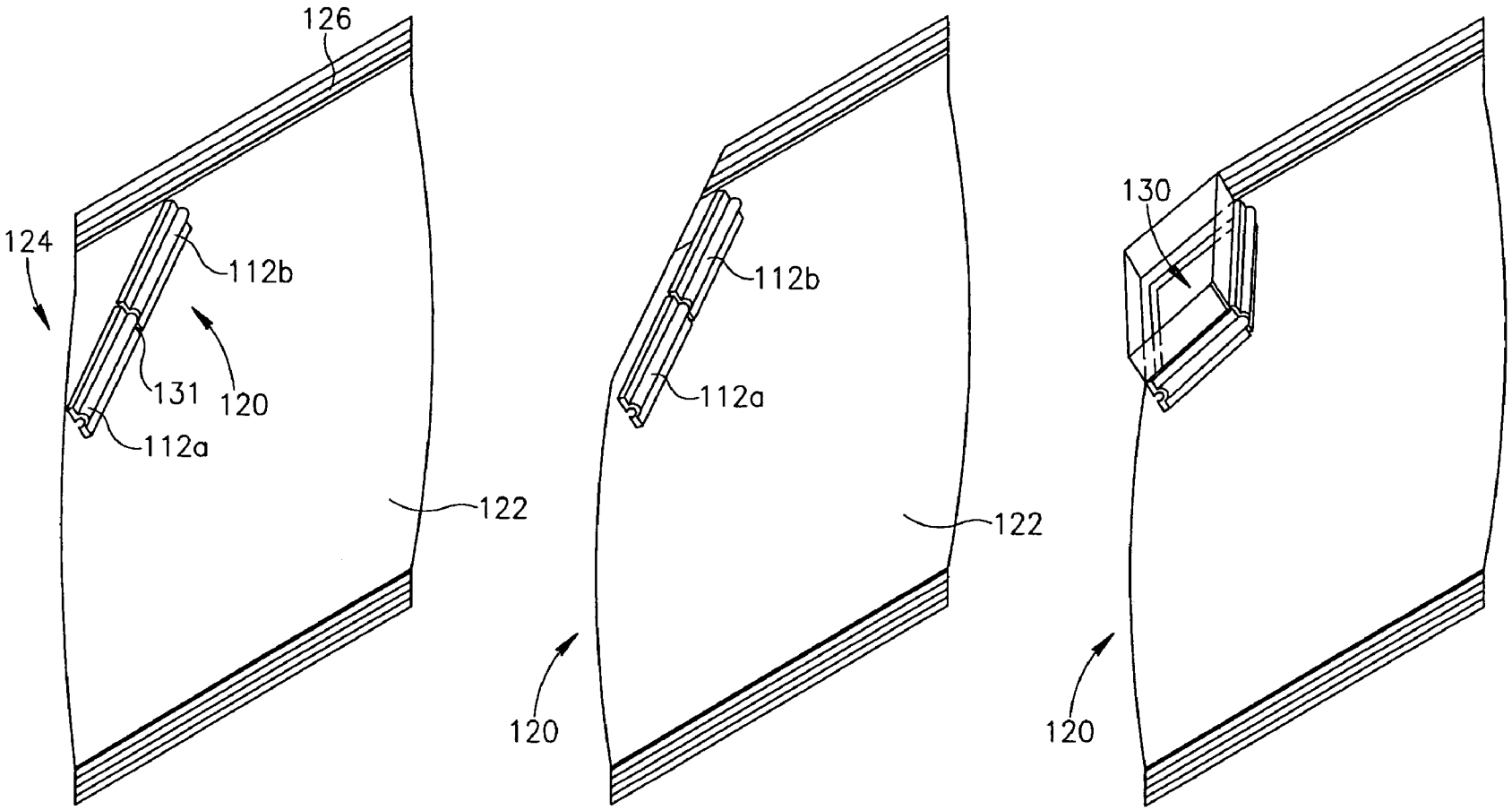
FIGS. 4A-4C illustrate a flexible bag with a closure in accordance with a fourth embodiment the present invention.

Turning now to FIG. 4, there is shown another embodiment of the present invention according to which closure 112 is disposed diagonally on bag 122, extending between seal strap 126 and a lower point along the side edge of package 120 as shown in FIG. 4A. Closure 110 comprises two elongate male units 112*a* and 112*b* disposed on wall 122 and two female members disposed on the opposite wall (not seen). In order to access the contents of package 120, the left corner of the package is cut off or removed diagonally above closure 112 as shown in FIG. 4B and closure 110 is then opened to form mouth 130. The portion removed diagonally may be removed prior to or after the sale of package 120. The closure 110 can be added when the package is manufactured or by the user of package 120 after purchase.

FIG. 5 illustrate yet another embodiment of a closure of the invention, generally designated 150, secured to a package 160. Package 160, which only its upper part is illustrated here, can be of any type as previously described, including non-gusseted as well as gusseted packages. Closure 150 comprises two elongate pairs of male-female units, 152-154*a* and 152-154*b* (shown partly). In accordance with this embodiment each pair of male and female units are connected by two elongated strips 155 which are disposed one opposite the other on the upper top of package 160 as is seen in FIG. 5A.

Figure 5B:
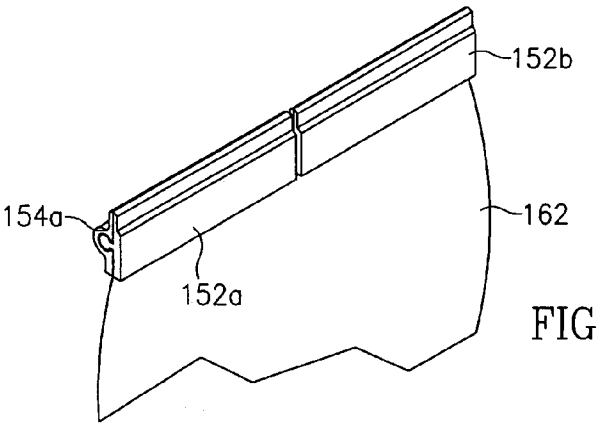
FIGS. 5A-5C illustrate a flexible bag with a closure in accordance with a fifth embodiment the present invention.
Figure 5D:
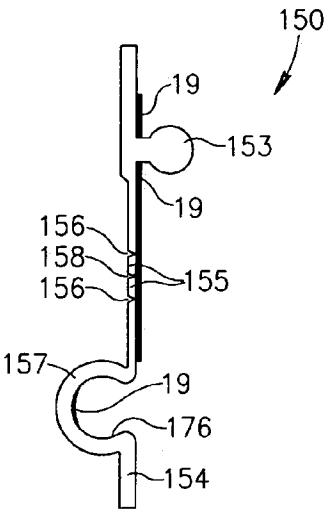
FIG. 5D is a cross sectional view of the closure of FIG. 5A before the closure is secured to the bag.
Figure 5A:
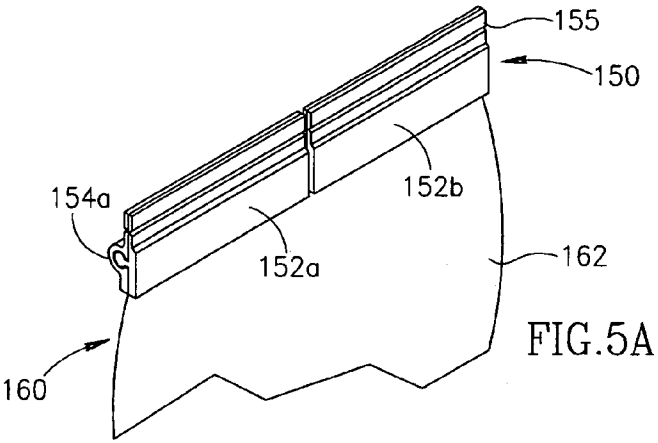
Figure 5C:
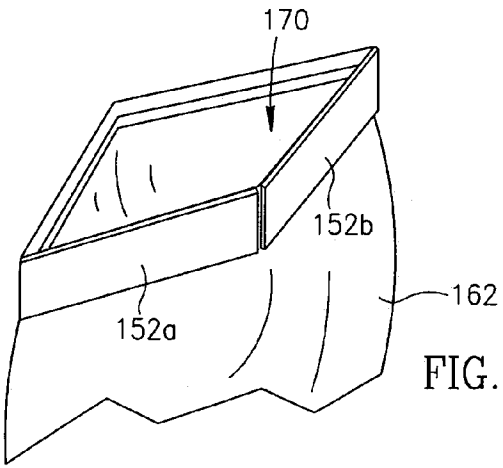

FIG. 5D depicts the profile of male-female pair 150 before it is attached to a package. As is seen, the two strips 155 are located between male unit 152 and female unit 154 are connected to each other as well as to the corresponding male-female members by very thin breakable connections 158 and 156, respectively. Thin connection 158, being a hinge around which the closure can be easily folded, allows for folding the closure and attaching it to the package from above such that one half of the closure including male member 152 is pressed against front wall 162 while the other half, including female member, 154 is pressed against rear wall 164. The profiles of male unit 152 and female unit 154 have a similar shape as described above in association with FIG. 1, having a rounded projection 153 and a rounded recess 157, respectively. Closure 150 is preferably secured to a sealed package such that strips 155 conceal the seal strap.

In order to open the package, connections 158 between strips 155 and members 152 and 154 are broken easily by folding the upper portion of the closure, i.e., strips 155 around thin connections 158. The package is then cut between the upper and lower portions of closure 150 as shown in FIG. 5B. Alternatively, connections 158 which are sufficiently thin, need not be cut prior to cutting and can be cut while cutting the package. Closure 170 can then be opened to form a diamond shape mouth 170 having the advantages as described above in association with FIG. 1. In accordance with this embodiment, since no rims are left above closure 150, the closure is adhered or bonded to the container also along the upper wings of the male and female units, as well as along strips 155, as illustrated in FIG. 5D, such that the container can be opened by pulling the upper portions of the closure apart. In order to facilitate grasping, upper wings may be made thinner than the lower and middle portions of the closure as is best seen in FIG. 5D.

It will be appreciated by that the closure of the invention may be made in various sizes and strengths wherein the closure strength is generally determined by the material from which it is fabricated and from its cross-sectional thickness. Generally, the closure dimensions depend on the container dimensions and in particular on the thickness and flexibility of the container walls. Preferably the total width of the closure is in the range of about 0.3 to 20 mm or more and the unit thickness across the wing portion is in the range of about 0.25 to 2 mm or more.

Figure 6B:
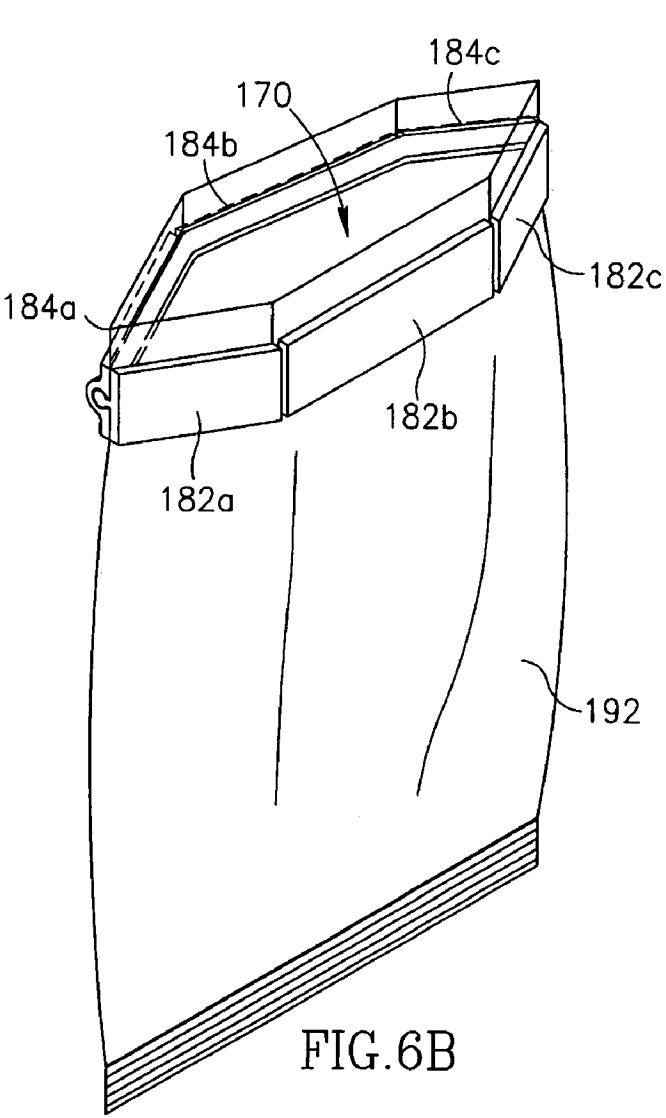
FIGS. 6A and 6B illustrate a flexible bag with a re-closable closure in accordance with a sixth embodiment of the present invention in closed and open positions respectively.
Figure 6A:
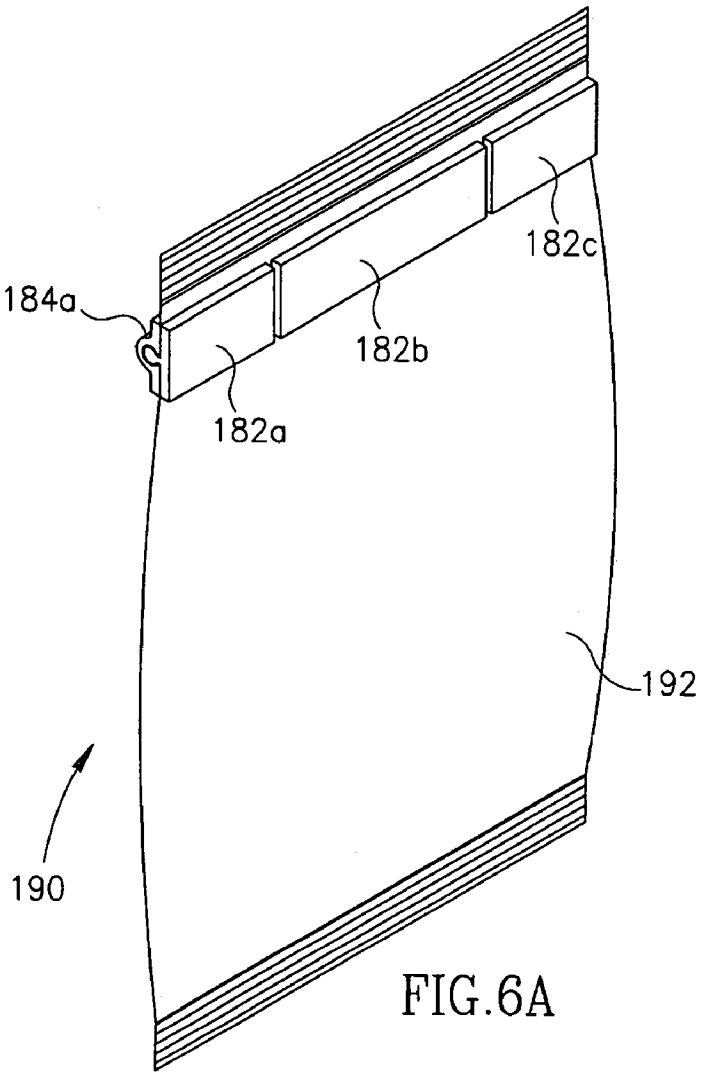

Likewise, the number of male-female pairs disposed on the container walls for separating the interior of the container from the container mouth may be selected to best fit the dimensions of the container mouth. Thus, for large containers, the closure of the invention may comprise any number of mail-female pairs disposed adjacent to the package mouth. FIG. 6 illustrate a closure of the invention, designated 180 secured to bag 190. Closure 180 comprises three male units 182*a*, 182*b* and 182*c* disposing a gap apart on front wall 192 of package 190 and three complementary female units 184*a*, 184*b* and 184*c* disposing a gap apart on opposite rear wall 194. After seal 196 is broken, closure 180 can be opened to form hexagonal mouth 170. It will be appreciated that regardless the number of male-female pairs, the gaps between adjacent members always serve as hinges for facilitating the separation of the closure.

Figure 7A:
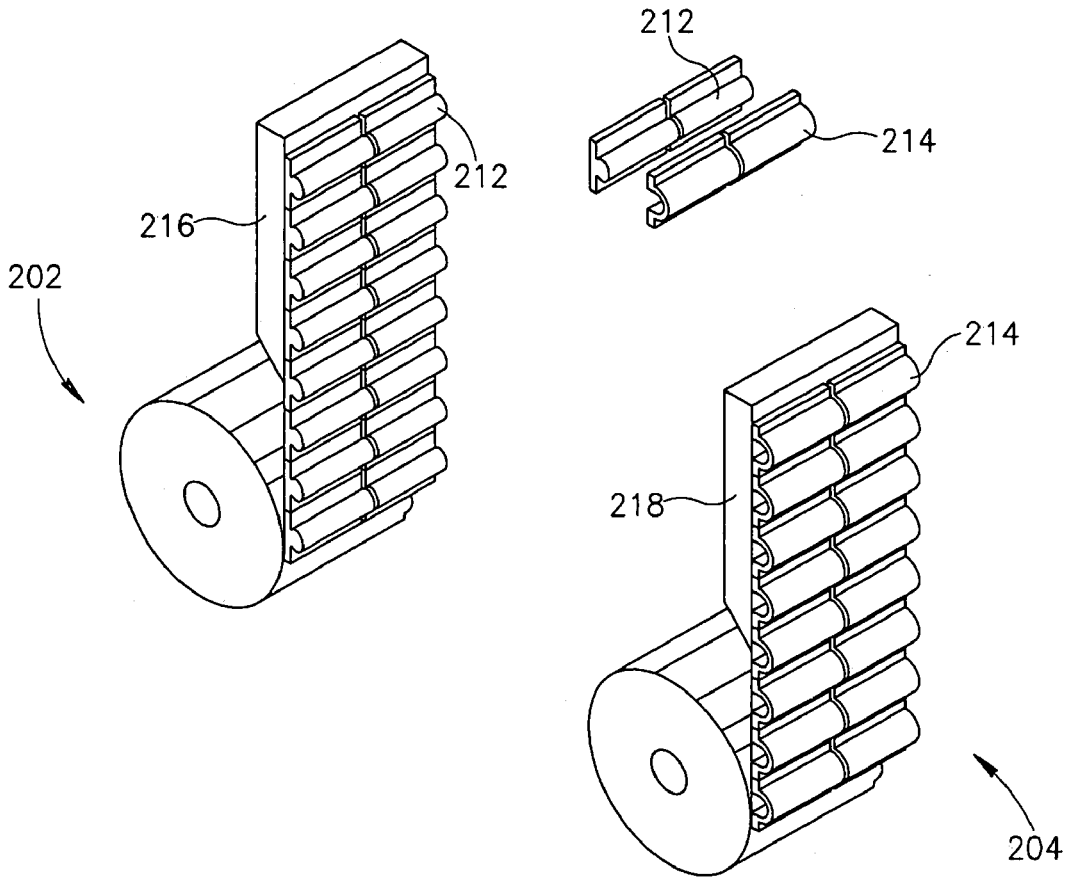
FIG. 7 illustrates a method for attaching a closure member of the invention to a flexible bag in a perspective and a cross-sectional view, respectively.

FIG. 7 illustrate an automated process for attaching the closure of the invention to packages. According to this process, a rolled ribbon 202 of a pair of male units 212 and a rolled ribbon 204 of pair of female units 214 are moved on mover mechanisms 216 and 218, respectively. Each ribbon comprises of a plurality of elongated unit pairs arranged along their elongated axis by thin breakable connections. The two units of a pair as well as one pair to adjacent pairs can be connected to each by thin breakable connections which break upon slight pressure as is well known in the manufacturing of plastic units. Alternatively, the units can be detachably placed on a support of a sheet material. Mover mechanisms 216 and 218, each provided with lugs and latches (not shown), push the upper units in the roller unwinding direction and the most upper unit, each in its turn, away from the roller in the perpendicular direction, toward packages 220 moving on a convey (not seen), or packaging machine or any bag making machine, such that units 212 is and 214 are located each on one side of package 220 against each other.

Figure 7B:
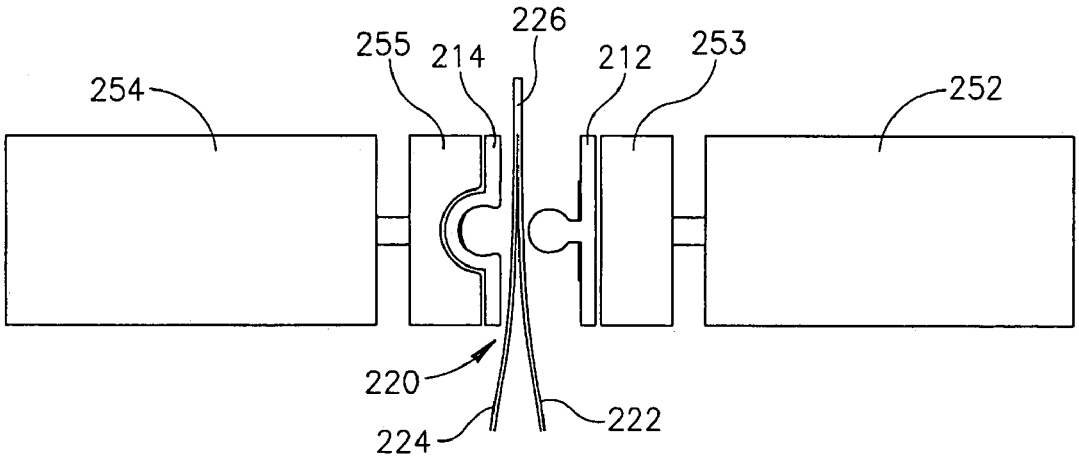

Turning now to FIG. 7B, two pressers 252 and 254 provided with moving pressing heads 253 and 255 respectively, press units 212 and 214 onto the upper part of package 220 and interlock them into each other. In the embodiment shown here each, rollers 202 and 204 comprise of unit pairs. However it will be appreciated that instead of using two rollers, each comprising of unit pairs, two separate rollers of male members and two separate rollers of female members can be used such that two pair of male-female members are directed toward the package and toward each other from opposite directions by four separate synchronized mover mechanisms.

Figure 8:
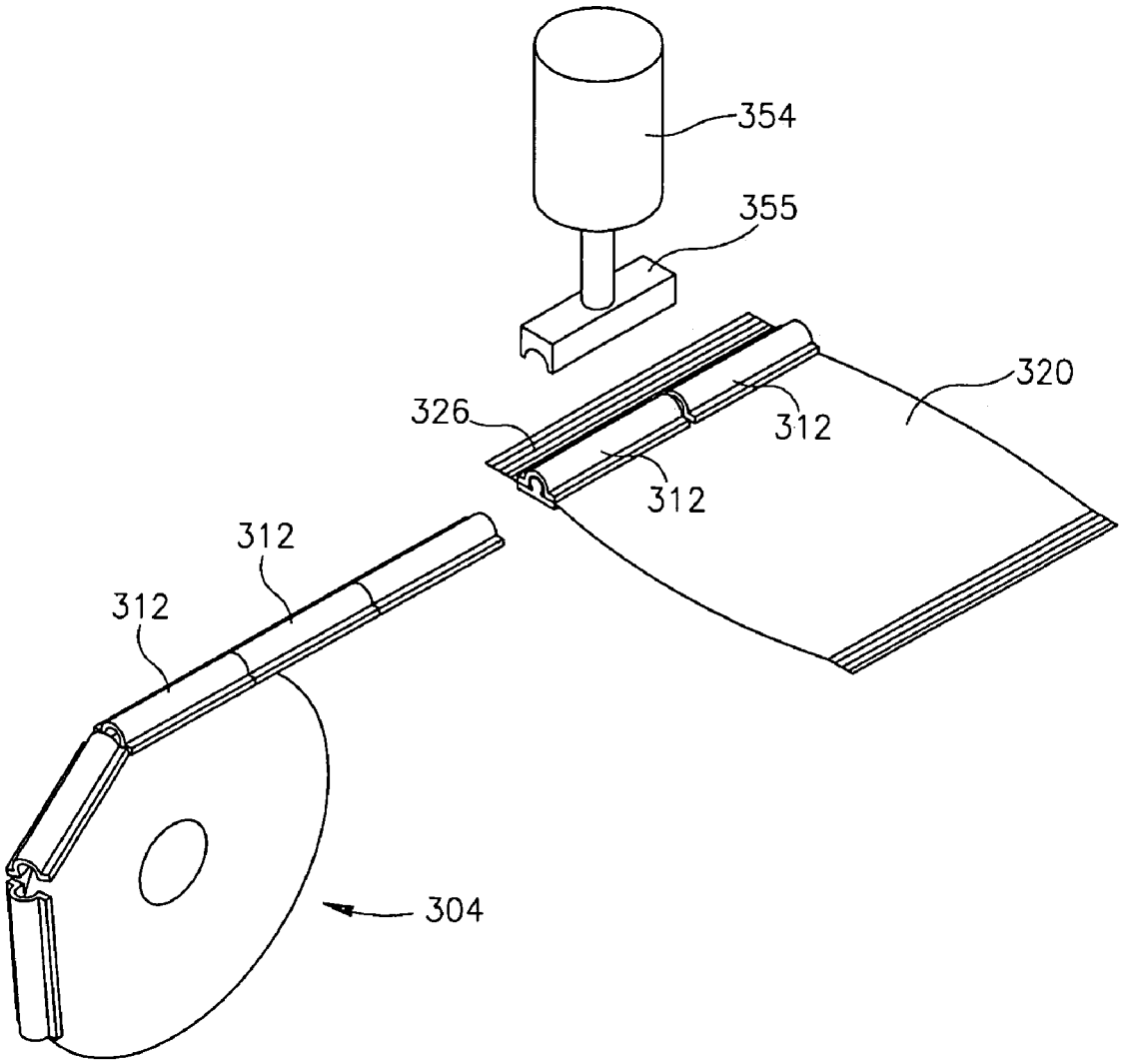
FIG. 8 illustrates an alternative arrangement for attaching a closure member of the invention to a flexible bag.

FIG. 8 illustrates another embodiment for automatic securing the closure of the invention to packages 320, according to which the closure units 312 are arranged along their narrow side. For clarity sake, only one roller 304 of female units 312 is shown. However it will be understood that a second roller of male units, as well as a second presser, are provided on the other side of package 320, pressing male units against the female units as described above. It will be realized that arranging the male and female units in a roller such as 304, i.e., where the units are connected to each other along their narrow end, is possible due to the novel construction of the closure of the invention, which comprises separate male-female pairs. Thus, a long ribbon of such units can be rolled to in a roller of a reasonable diameter while it is not practical to form such a roller where the length of the units equals the container width.

Figure 9A:
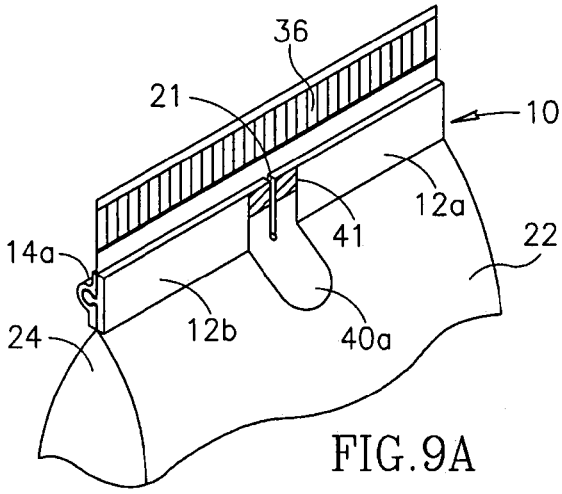
FIGS. 9A-9F illustrates various tongue members for facilitating opening the closure of the invention; A, C and E show the upper portion of a bag with a closure of the invention prior to breaking the seal; B, D and F show the bags of A, B and C, respectively, in open position.
Figure 9B:
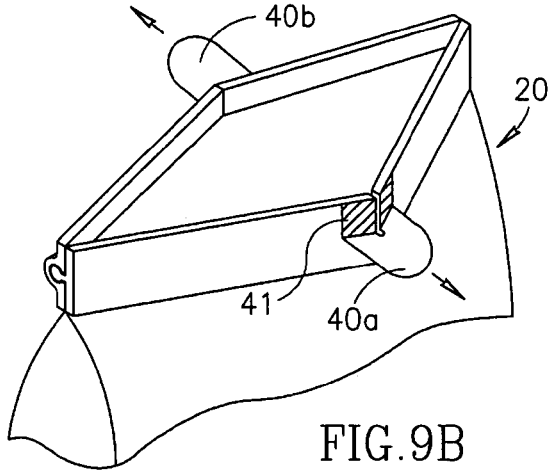
Figure 9C:
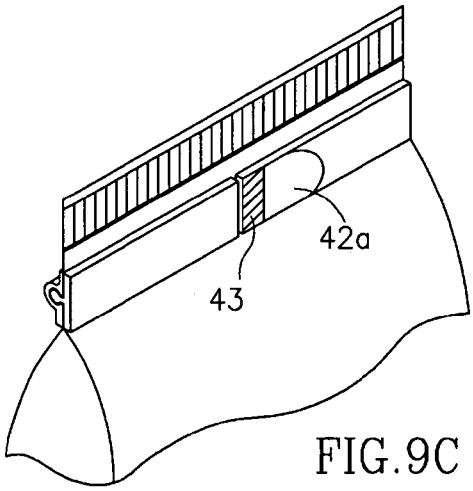
Figure 9D:
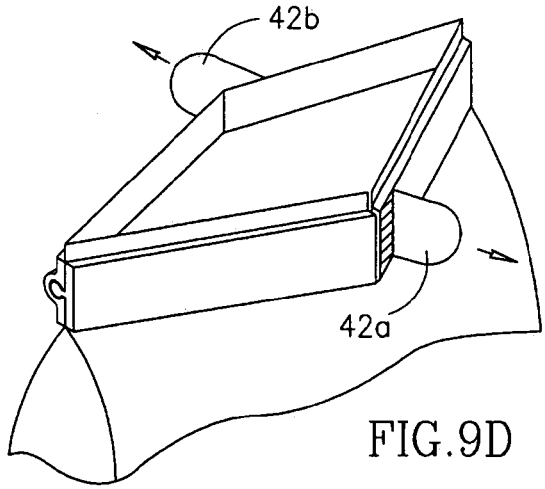
Figure 9E:
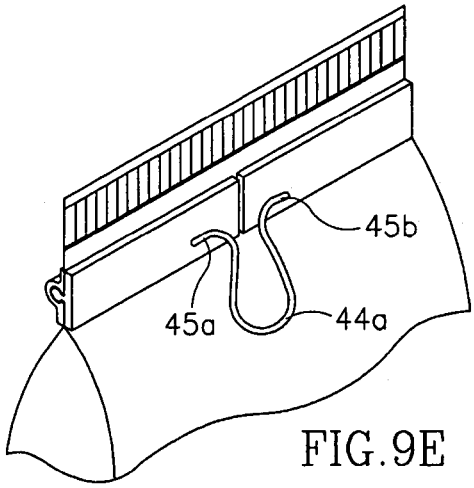
Figure 9F:
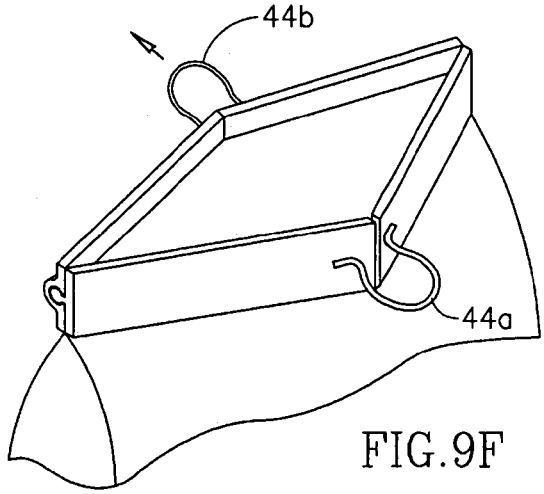
Figure 10A:
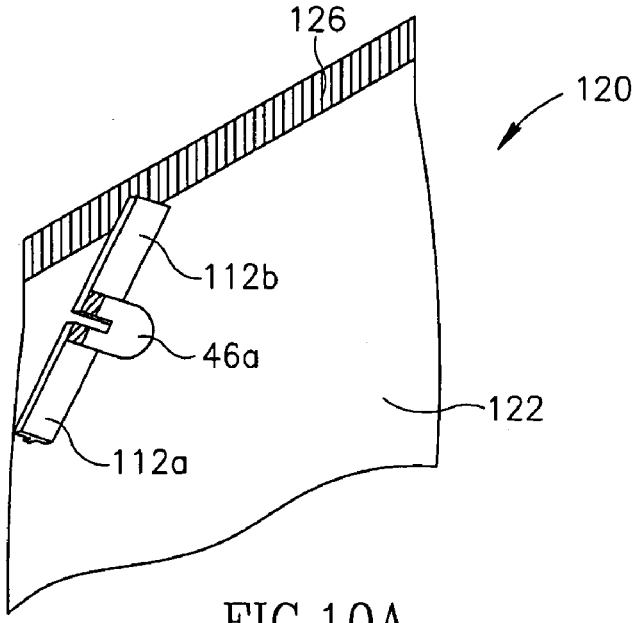
FIGS. 10A and 10B illustrate the upper portion of a bag with yet another embodiment of the invention in a closed and an open position.
Figure 10B:
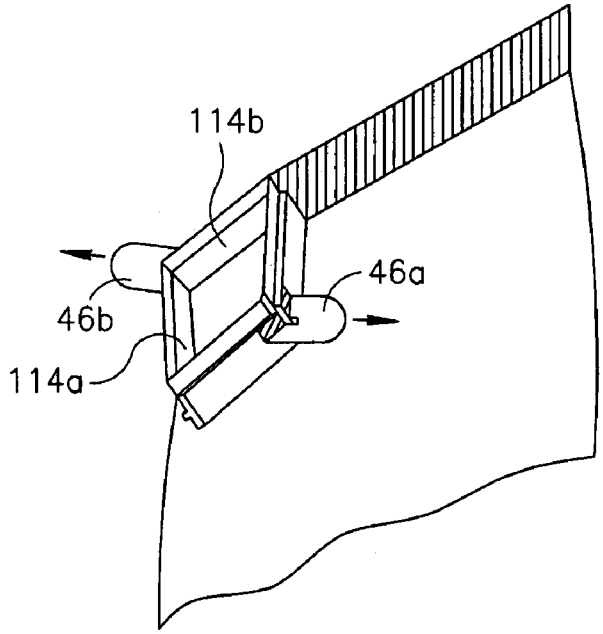

Referring now to FIGS. 9 and 10, there are shown yet further embodiments of the closure of the invention according to which the closure is provided with at least one tongue member for facilitating opening the closure by pulling the tongue outwardly.

FIGS. 9A-F depict, in combination, a bag 20 and a closure 10 same as depicted in FIG. 1. Bag 10 comprises two opposite walls 22 and 24 sealed at their upper end by sealing 36 and at their bottom end (not shown). Walls 22 and 24 may be directly connected to each other along their lateral sides or via two side-walls interposed between walls 22 and 24. Closure 10 comprises two male units 12*a* and 12*b* attached to the external surface of wall 22 and two corresponding female units 14*a* and 14*b* attached to the external surface of opposite wall 24. Male units 12*a* and 12*b* as well as female units 14*a* and 14*b* are separated by a narrow gap 21 as described in association with FIGS. 1-6.

In accordance with the embodiments shown here, closure 10 is further provided with a tongue or like device for facilitating the opening of the bag. The tongue member is a flap-like unit made of flexible material lying substantially adjacent and parallel to the closure outer surface, in contact therewith, but can be grasped by fingers to be partially pulled outwardly for facilitating pulling units 12 and 14 apart. Preferably, but not limited to, the tongue is made of a thin sheet of the same material as of closure 10 for facilitating the sealing and for enhancing the connection between tongue and for preventing rupture or breaking of the tongue upon excessive pulling forces. The tongue may be fabricated as an integral part of the closure or can be attached to the closure by any suitable attaching means.

FIG. 9A illustrates a tongue member 40*a* secured at its upper portion to male units 12*a* and 12*b* via sealing areas 41. Sealing areas 41 cover about half the width of closure 10. Preferably, tongue 40*a* includes a cut shaped to match gap 21 between units 12*a* and 12*b* such the tongue does not exert any tension when closure 10 is opened to form a mouth. Tongue 40*a* may extend below the lower edge of closure 10 for enhancing the grip of tongue 40*a* by fingers. In its relaxed position, tongue 40*a* lies flat against wall 22. A similar tongue 40*b* (seen in FIG. 9B) is connected in a similar way to female members 14 on opposite wall 24. In order to open the bag, tongues 41*a* and 41*b* are pulled upwardly and outwardly in opposite directions as shown in FIG. 9B.

Another arrangement of pulling tongues is shown in FIGS. 9C and 9D where two tongues 42 are each connected to only one of the male and female units. Tongue 42*a* is connected to male unit 12*a* via attaching area 43 adjacent to the gap between the two male units. A similar tongue 42*b* is connected to corresponding female unit 14*b* (not shown). In their relaxed positions tongues 42 lie flat in contact with closure 10. In order to open the bag, tongues 42 are pulled outwardly in opposite directions as is shown in FIG. 9D.

FIGS. 9E-9F show yet another embodiment according to which tongue 44*a* is a handle-like ring-pull connected to male units 12*a* and 12*b* by lateral portions 45*a* and 45*b*, respectively. As can be seen in FIG. 9E, in its relaxed position, ring-pulls 44*a* and 44*b* lie in contact with the bag walls. In order to open the bag, rings 44 are pulled upwardly and outwardly to a position substantially perpendicular as is shown in FIG. 9F.

It will be appreciated that a tongue as shown in FIG. 9 can be included with any of the other closures of the invention as described in FIG. 1 through 6 for facilitating opening the closure. One example is shown in FIG. 10, where closure 110, diagonally disposed as described in association with FIG. 4, is provided with tongues 46. It will be also realized that although it is preferred to provide a closure of the invention with two tongues located at opposite male-female units of the closure for enabling the application of simultaneous forces in opposite directions, it is possible to provide the closure with only one tongue connected to at least one male unit or at least one female unit.

It will be easily appreciated by a person skilled in the art that the use of the present closure is not limited to the packages described above and that it can be attached to many other packages as well for providing an air tight closing. Likewise it will be realized that the closure of the present invention may be attached to unsealed empty containers as well. For example, empty packages with the present closure can be useful where goods are sold to customers by weight. In such cases, the distributor of the goods can pack the goods in empty bags provided with the closure of the present invention such that the closure is the only sealing means provided with the container.

It will be appreciated by persons skilled in the art that the present invention is not limited to what has been particularly shown and described hereinabove. Rather the scope of the present invention is defined only by the claims which follow.

What is claimed is:

1. In combination a container and a closure for enhancing accessibility to contents of the container when the container is opened and for minimizing exposure of the container contents to ambient air when the container is closed, the container is having two opposite walls connected to each other and a mouth for providing an access to the container contents, each of said two opposite walls is having an inner surface and an outer surface, the closure comprising:

two separate elongated male units, each having a longitudinal axis, the two male units being disposed a gap apart completely separated from each other by said gap on the outer surface of one of said two opposite walls adjacent to the mouth, such that the longitudinal axes of said two male members coincide with each other;

two separate corresponding elongated female units, each having a longitudinal axis, the two female units being disposed a gap apart completely separated from each other by said gap on the outer surface of the second wall opposite the two male units such that the longitudinal axes of said two female members coincide with each other, wherein the male and female units are configured to snap fit into each other so as to form two separate male-female pairs; and at least one pulling tongue member connected to at least one of the male units or to at least one of the female units for facilitating opening the closure.

2. The container of claim 1 wherein the container is a flexible package fabricated from a single layer or a multiple layer sheet material.

3. The container of claim 1 wherein the container is a non-gusseted package and wherein said two walls are directly connected to each other.

4. The container of claim 1 wherein the container is a gusseted package having two side walls interposed between said two opposite walls.

5. The container of claim 1 wherein the mouth is initially sealed.

6. The container of claim 1 wherein the closure is fabricated from rigid or semi-rigid material.

7. The container of claim 1 wherein the closure is made of plastic material.

8. The container of claim 1 wherein the closure is made of metal or metal alloy.

9. The container of claim 1 wherein each male unit comprises two flat elongated wings and an elongated projection interposed there between and wherein each female unit comprises two flat elongated wings and an elongated recess portion interposed there between, said elongated projection and said elongated recess portion are having complementary profiles for allowing snap fitting said projection into said recess portion.

10. The container of claim 1 wherein the male unit and the female unit of each of said two male-female pairs when manufactured are connected to each other by two elongated strips interposed there between, the two elongated strips are connected to each other and to the male and female units by thin breakable connections for allowing securing the closure to the mouth of the container strips by folding the closure around the connection between said two elongated strips such that one elongated strip connected to the male unit of said male-female pair is disposed on one wall of the container and the second elongated strip connected to the female unit of said male-female pair is disposed on the second wall of the container.

11. The container of claim 1 wherein the closure is disposed diagonally on said two opposite walls.

12. The container of claim 1 wherein the mouth is sealed by a sealing strip comprising a first portion and a second portion separated by a sealing wherein at least one of the two male-female pairs is disposed below the first portion leaving an unsealed strip between said at least one male-female pair and said first portion and wherein at least another one of the two male-female pairs is disposed at least partly on the second portion.

13. The container of claim 1 wherein the at least one pulling tongue member comprises a first tongue connected to at least one of the two male units and a second tongue connected to at least one of the two female units.

14. The container of claim 1 wherein said at least one tongue member is connected to both male units or to both female units.

15. The container of claim 14 wherein the tongue member includes a cut to match the gap between the two male or the two female units.

16. The container of claim 1 wherein the tongue member is made of a flexible material.

17. The container of claim 1 wherein the tongue member is made of the same material as the closure.

18. A re-closable container comprising:

two opposite walls connected to each other, each having an inner surface and an outer surface;

a mouth for providing an access to the container contents; and a closure, the closure comprises two or three elongated male units, each having a longitudinal axis, the two or three male units being disposed a gap apart completely separated from each other on the outer surface of one of said two opposite walls adjacent to the mouth, such that the longitudinal axes of said two or three male units coincide with each other;

two or three elongated corresponding female units, each having a longitudinal axis, the two or three female units being disposed a gap apart completely separated from each other on the outer surface of the second wall opposite the male units, the longitudinal axes of said female units coincide with each other; the male and female units are configured to snap fit into each other; and at least one tongue member connected to at least one of the elongated male units or to at least one of the elongated female units for facilitating opening the closure.

19. The container of claim 18 wherein the container is a flexible package fabricated from a single layer or a multiple layer sheet material.

20. The container of claim 18 wherein the two opposite walls are directly connected to each other.

21. The container of claim 18 further comprising two side walls interposed between said two opposite walls.

22. The container of claim 18 wherein the mouth is initially sealed.

23. The container of claim 18 wherein the closure is disposed diagonally on said two opposite walls.

24. The container of claim 18 provided with a first tongue member connected to at least one of the male units and a second tongue member connected to at least one of the female units.

25. The container of claim 18 wherein said at least one tongue member is connected to two of the at least two or three male units or to two of the at least two or three female units.

26. The container of claim 18 wherein the tongue member includes a cut to match the gap between the male or female units.

27. The container of claim 18 wherein the tongue member is made of flexible material.

28. The container of claim 18 wherein the tongue member is an integral part of the closure.

29. The container of claim 18 wherein the tongue member is configured as a pull-ring.

30. A re-closable container comprising:

two opposite walls connected to each other, each having an inner surface and an outer surface;

a mouth for providing an access to the container contents; and a closure, the closure comprises two or three elongated male units, each having a longitudinal axis, disposed a gap apart on the outer surface of one of said two opposite walls adjacent to the mouth, such that the longitudinal axes of said male members coincide with each other;

two or three elongated corresponding female units, each having a longitudinal axis, disposed a gap apart on the outer surface of the second wall opposite the male members, the longitudinal axes of said female members coincide with each other; the male and female units are configured to snap fit into each other; and at least one tongue member connected to two adjacent male units or to two adjacent female units wherein said tongue member includes a cut to match the gap between the two adjacent male or female units.

* * * * *